US005417397A

United States Patent [19]

Harnett

[11] Patent Number: 5,417,397

[45] Date of Patent: May 23, 1995

[54] MAGNETIC SOAP HOLDER

[76] Inventor: Charles B. Harnett, 229 Little Pigeon Dr., Sevierville, Tenn. 37862

[21] Appl. No.: 173,752

[22] Filed: Dec. 23, 1993

[51] Int. Cl.[6] ..... A47G 29/00

[52] U.S. Cl. ..... 248/309.4; 248/684; 248/206.5

[58] Field of Search ..... 248/309.4, 684, 206.5, 248/467, 537, 683; 211/DIG. 1

[56] References Cited

U.S. PATENT DOCUMENTS

| | | | |
|---|---|---|---|
| D. 253,147 | 10/1979 | Heckler | D6/90 |
| D. 253,148 | 10/1979 | Heckler | D6/90 |
| D. 253,149 | 10/1979 | Heckler | D6/90 |
| D. 277,820 | 3/1985 | Maayeh | D6/538 |
| 2,597,925 | 5/1952 | Edger | 45/28 |
| 2,642,999 | 6/1953 | McPherson | 211/DIG. 1 X |
| 2,798,241 | 7/1957 | Cohen | 248/683 X |
| 2,825,177 | 3/1958 | Nordlof et al. | 45/28 |
| 3,169,743 | 2/1965 | Page, Jr. | 248/206.5 |
| 3,472,391 | 10/1969 | Bolognesi | 211/65 |
| 3,552,705 | 1/1971 | Caster | 248/206 |
| 4,058,357 | 11/1977 | Wallace | 211/DIG. 1 X |
| 4,207,975 | 6/1980 | Arzillo | 248/309.4 X |
| 4,586,616 | 5/1986 | Cooper et al. | 248/206.5 X |
| 5,039,047 | 8/1991 | Pitzo | 248/206.5 |
| 5,163,566 | 11/1992 | Hempel | 211/65 |

FOREIGN PATENT DOCUMENTS

| | | | |
|---|---|---|---|
| 1369882 | 7/1964 | France | 248/309.4 |
| 1515966 | 1/1968 | France | 248/683 |
| 1550652 | 12/1968 | France | 248/309.4 |
| 0321047 | 6/1957 | Switzerland | 248/309.4 |
| 0760398 | 10/1956 | United Kingdom | 248/309.4 |
| 0951137 | 3/1964 | United Kingdom | 248/309.4 |

*Primary Examiner*—Karen J. Chotkowski
*Attorney, Agent, or Firm*—Pitts & Brittian

[57] ABSTRACT

An improved magnetic soap holder (10) for suspending a bar of soap and, if desired, utensils so that each may dry. The improved magnetic soap holder (10) includes a soap-holding magnet (20) used to attract the soap-holding plate (14), which is imbedded into a bar of soap. The soap-holding magnet (20) is placed in a soap-holding-magnet housing (18) to concentrate the magnetic force thus allowing a magnetic pull through a greater distance. This in turn allows an arm underside covering (24) to be employed, making cleaning easier. The bar of soap is suspended from the arm (12) when the soap-holding plate (14) is brought into magnetic contact with the soap-holding magnet (20). In an alternate embodiment, there is also at least one utensil-holding magnet (30) used to attract a utensil-holding piece (40), which is adhesively backed and which is attached to a utensil. The utensil is suspended from the arm (12) when the utensil-holding piece (40) is brought into magnetic contact with the utensil-holding magnet (30).

18 Claims, 3 Drawing Sheets

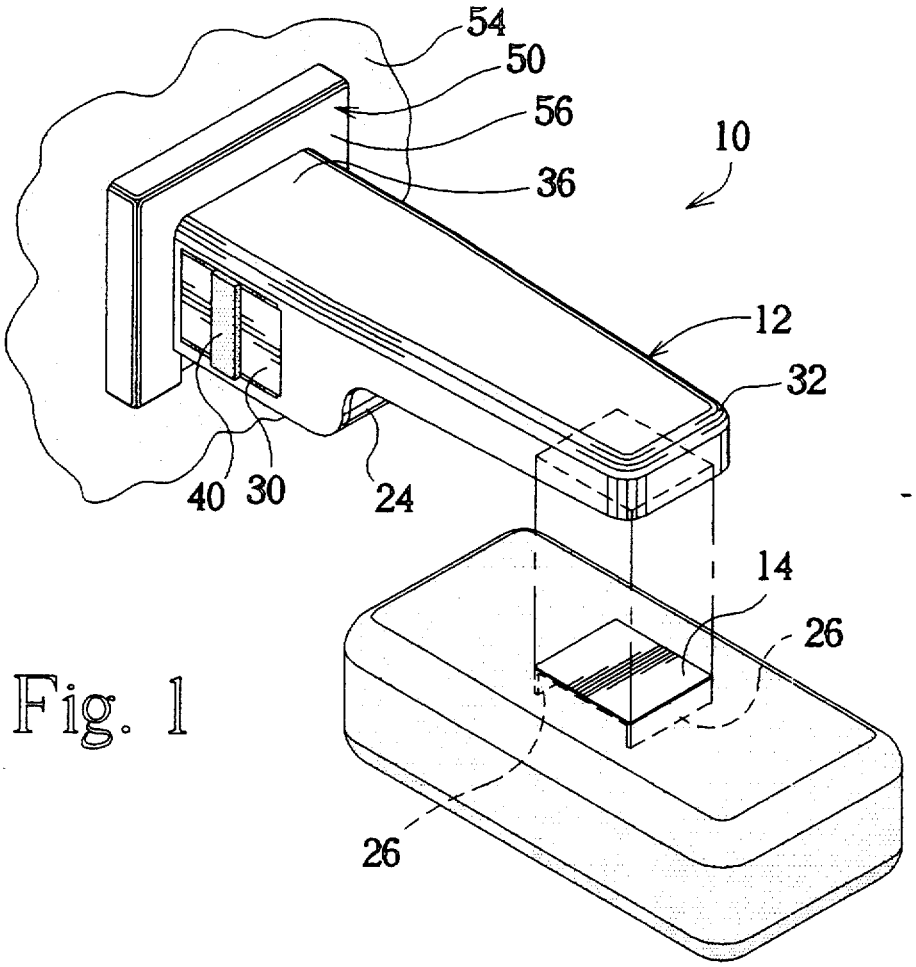
Fig. 1
Fig. 2
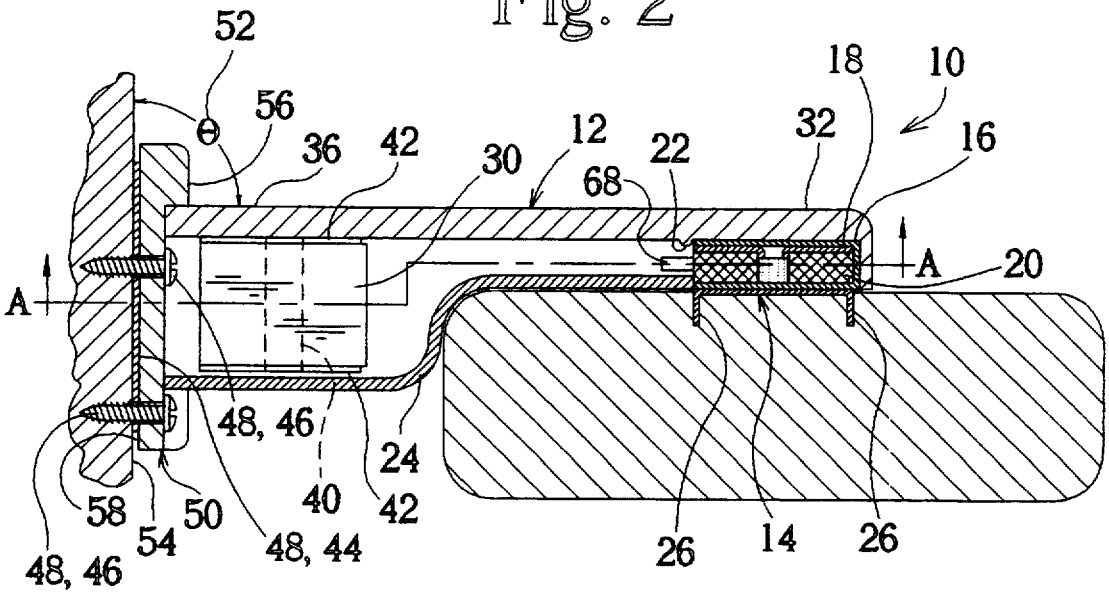

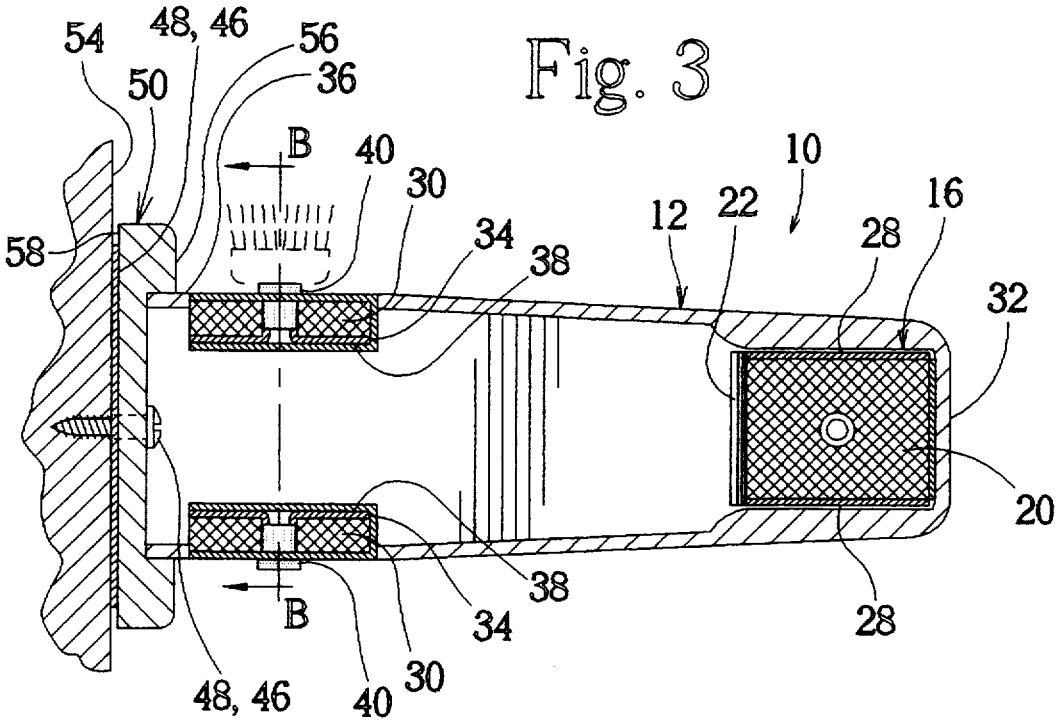
Fig. 3
Fig. 4
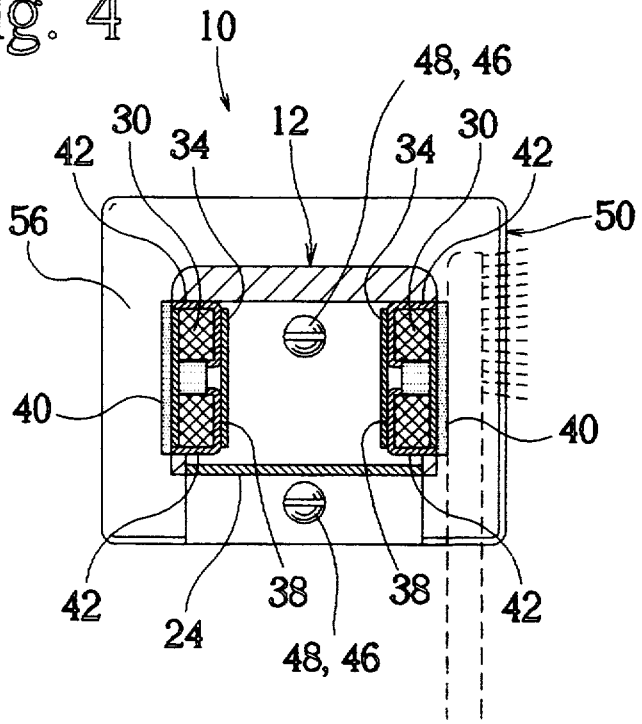

MAGNETIC SOAP HOLDER

TECHNICAL FIELD

This invention relates to the field of magnetic soap holders. Specifically, this invention allows a soap-holding magnet, its associated soap-holding-magnet housing, and a magnetically activated soap-holding plate embedded into a bar of soap to secure a bar of soap in mid-air. The improved magnetic soap holder offers advantages over previous magnetic soap holders.

BACKGROUND ART

When wet soap is placed in a soap dish or placed on the rim of the basin of a sink or washtub, the bottom of the soap often becomes viscous, or "gloppy," as some people might say. Some of this viscous soap hardens on the surface of the soap dish or basin becoming soap scum. This requires time, energy, and money to clean. The rest of the viscous soap usually remains on the bar of soap only to be washed down the drain the next time soap is used. These are obviously wasteful occurrences.

To solve this problem, people have heretofore used magnetic soap holders. By and large, the magnetic soap holders comprise an arm, a magnet, and a magnetically activatable soap-holding plate. The arm is substantially parallel to the ground and mounted so as to be substantially perpendicular to a wall, i.e. sticking out from a wall. The soap-holding magnet is embedded in or attached to the underside of the arm. The magnetically activated soap-holding plate is inserted into the soap. The bar of soap then hangs from the arm due to the magnetic force drawing the magnetically activated soap-holding plate in the bar of soap to the soap-holding magnet in the arm. The bar of soap then dries simply by hanging in the air suspended above such surfaces as the sink basin. Several inventions utilize this basic structure. These include: U.S. Pat. No. 2,597,925, issued to Urey Edger on May 27, 1952; U.S. Pat. No. 2,825,177, issued to Ragnar Nordlof and Leif Nordlie on Mar. 4, 1958; U.S. Pat. No. 3,472,391, issued to Gino Bolognesi on Oct. 14, 1969; and U.S. Pat. No. 3,552,705, issued to Eldred Caster on Jan. 5, 1971. However, all of these inventions have drawbacks.

For instance, all of these inventions use substantially or partially exposed magnets. The magnets used were circular. Circular magnets do not allow a strong enough magnetic pull through any significant distance because the magnetic force is not concentrated. Thus, the circular soap-holding magnet and magnetically activatable soap-holding plate must be in direct contact (i.e. the circular magnet must be exposed) to properly secure the soap. The exposed magnet gives more nooks and crannies in which dirt and soap scum could collect, making cleaning of the magnetic soap holder difficult.

The present invention solves this and other problems. The soap-holding magnet is rectangular or square, as opposed to circular. This also allows a soap-holding-magnet housing to be used. This soap-holding-magnet housing is a u-shaped metal plate with a securement device, such as downward bent flanges, fitted over the soap-holding magnet. This concentrates the magnetic force at the edges of the flanges of the u-shaped soap-holding-magnet housing and increases the magnetic force at the edges of the flanges. Due to this increased magnetic force, the soap-holding-magnet is able to attract a heavier, larger bar of soap. This also means that the soap-holding-magnet need not be exposed as long as the bottom edges of the flanges are exposed. This allows the improved magnetic soap holder to employ a thin layer of material to cover the soap-holding-magnet compartment, or, alternatively, the entire underside of the arm, leaving slots through which the flanges of the soap-holding-magnet housing protrude. This thin layer of material is preferably the same material of which the rest of the arm is made. The soap-holding-magnet maagnet and the soap-holding-magnet housing are still able to attract the magnetically activated soap-holding plate but are not exposed to dirt. The surface of the arm underside covering is a relatively smooth one, thus making cleaning easier. Employing the arm underside covering also protects ceramic magnets which are easily broken if struck directly.

The present invention also utilizes a boss in the soap-holding-magnet compartment. The boss is a small protrusion running the entire width of the arm which allows the soap-holding magnet and the soap-holding-magnet housing to be secured by being snapped into the soap-holding-magnet compartment. This manufacturing step is done in one, quick motion by a human or robot. This saves money compared to other methods which are relatively intensive in terms of labor and time, such as gluing or screwing down the soap-holding-magnet and soap-holding-magnet housing.

In addition, all of the above cited magnetic soap holders have relatively short arms. This means that the bar of soap is secured such that the bar's longer axis is substantially parallel to the ground but substantially perpendicular to the arm. (Other orientations are those such as disclosed in U.S. Pat. No. 3,169,743, issued to John S. Page, Jr. on Feb. 16, 1965, which uses no arm, and the Edger invention which holds the bar such that the bar's longer axis is vertical and perpendicular to the arm.) Because of this, a large portion of the bar of soap is exposed to errant movement of such things as arms and washcloths.

The present invention utilizes an arm which is long enough to accommodate a family-sized bar of soap. This allows the soap to be secured so that its longer axis is substantially parallel to the arm. Because of this, most of the soap is protected by the arm allowing less chance for the soap to be knocked off. However, the present invention also allows the soap to be held in any attitude. The improved magnetic soap holder is able to employ a longer arm and, thus, hold larger, family-sized bars of soap because the soap-holding magnet in combination with the soap-holding-magnet housing creates greater magnetic force.

Finally, the present invention, in an alternate embodiment, also has one or more rectangular or square utensil-holding magnets in the second end of the arm. This allows the improved magnetic soap holder to hold other items which are normally used in the same area as soap, including, but not limited to, toothbrushes, safety razors, combs, and other utensils. One invention, U.S. Pat. No. 5,163,566, issued to Jeffrey Hempel on Nov. 17, 1992, uses magnets to hold toothbrushes, but none of the above cited inventions combined the use of magnets to hold both soap and other items in the same invention.

Therefore, it is an object of the present invention to provide a soap-holding-magnet with a soap-holding-magnet housing so as to concentrate the magnetic force at the edges of the flanges of the soap-holding-magnet housing and create greater lifting strength.

It is also an object of the present invention to provide an improved magnetic soap holder with unexposed magnets, thus allowing the improved magnetic soap holder to be more easily cleaned.

It is an additional object of the present invention to provide a less costly and time consuming means of securing the soap-holding and utensil-holding magnets, to be achieved through use of a boss which allows the soap-holding magnet and the soap-holding-magnet housing to be quickly snapped into place.

It is a further object of the present invention to provide an improved magnetic soap holder with an arm long enough to accommodate a family-sized bar of soap.

It is yet another object of the present invention to provide an improved magnetic soap holder which also uses utensil-holding magnets to hold other items, including, but not limited to, toothbrushes, safety razors, and other utensils.

DISCLOSURE OF THE INVENTION

Other objects and advantages are accomplished by the present invention which serves to suspend soap above surfaces of a basin, tub, etc., thus, allowing the soap to dry without leaving soap scum or viscous soap. The improved magnetic soap holder of the present invention includes an arm and a base. The second end of the arm is attachable to the first side of the base. The second side of the base is attachable to a vertical supporting surface, such as a wall. When attached, the arm is substantially parallel to the ground. The arm contains one or more compartments dimensioned to securely hold one magnet each. The underside of the arm is covered with an arm underside covering. There are two slots in the arm underside covering near the first end of the arm. There is also at least one soap-holding-magnet compartment near the first end of the arm.

The improved magnetic soap holder also includes at least one soap-holding-magnet and its u-shaped soap-holding-magnet housing. The soap-holding magnet and its u-shaped soap-holding-magnet housing are designed to be received by the soap-holding-magnet compartment near the first end of the arm. The soap-holding-magnet and its u-shaped soap-holding-magnet housing suspend the soap above surfaces such as basins by means of magnetic interaction with a plate imbedded in the bar of soap. The soap is used simply by disengaging the soap and plate combination from the arm. When the person is done with the soap, he or she re-engages the soap and plate combination simply by bringing the plate into magnetic contact with the underside of the arm wherein the magnet is housed.

In an alternate embodiment, the arm and the base are integrally formed.

In another alternate embodiment, there is also one or more utensil-holding magnets inside the body of the arm, for holding such items as toothbrushes and safety razors. If one or more utensil-holding-magnets and the associated utensil-holding-magnet housings are used, several utensil-holding pieces are used. These utensil holding pieces are pieces of adhesively backed, rust resisting, magnetically activatable material which are attached to such utensils as toothbrushes and safety razors. The magnetic force of a utensil-holding magnet and its associated housing then attracts the utensil-holding piece and holds the utensil-holding piece/utensil combination above any surfaces.

In another alternate embodiment, a base is provided which mounts onto a supporting surface such as a wall. The second end of the arm is selectively secured to the base.

BRIEF DESCRIPTION OF THE DRAWINGS

The above mentioned features of the improved magnetic soap holder will become more clearly understood from the following detailed description of the invention read together with the drawings in which:

FIG. 1 is a perspective view of the improved magnetic soap holder constructed in accordance with several features of the present invention showing the relationship between the soap and the improved magnetic soap holder as the bar of soap is being attached thereto;

FIG. 2 illustrates a side elevational view of the improved magnetic soap-holder showing the soap holding magnet and soap holding magnet housing being held in place by the boss;

FIG. 3 is a top view, in section, of the improved magnetic soap holder taken at A—A of FIG. 2;

FIG. 4 illustrates a front elevational view, in section, of the improved magnetic soap holder taken at B—B of FIG. 3;

BEST MODE FOR CARRYING OUT THE INVENTION

Figure 5:
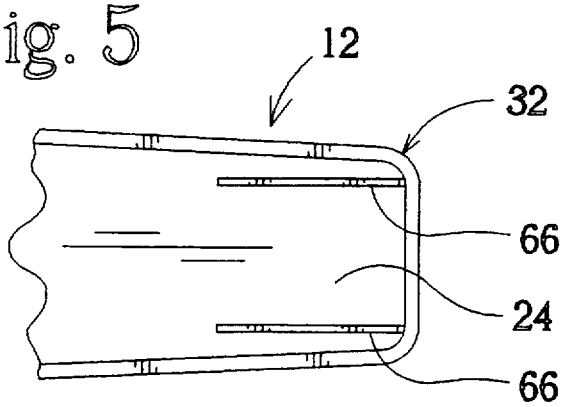
FIG. 5 is a bottom plan view of the first end of the arm.
Figure 6:
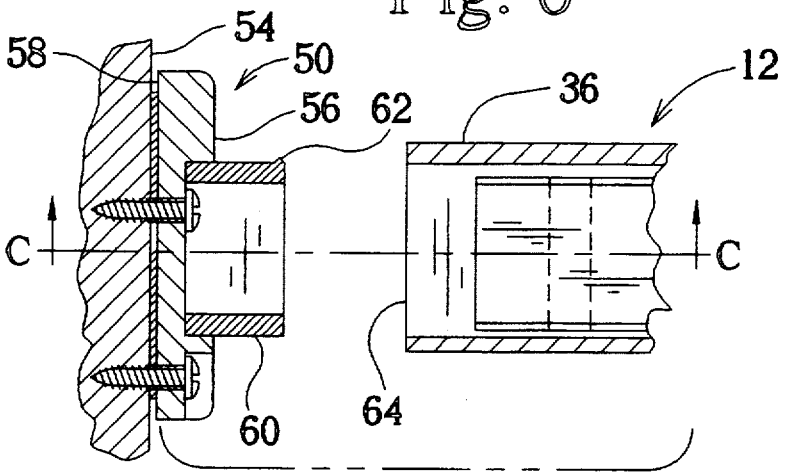
FIG. 6 is an exploded side elevational view, in section, of one embodiment of the improved magnetic soap holder of the present invention.
Figure 7:
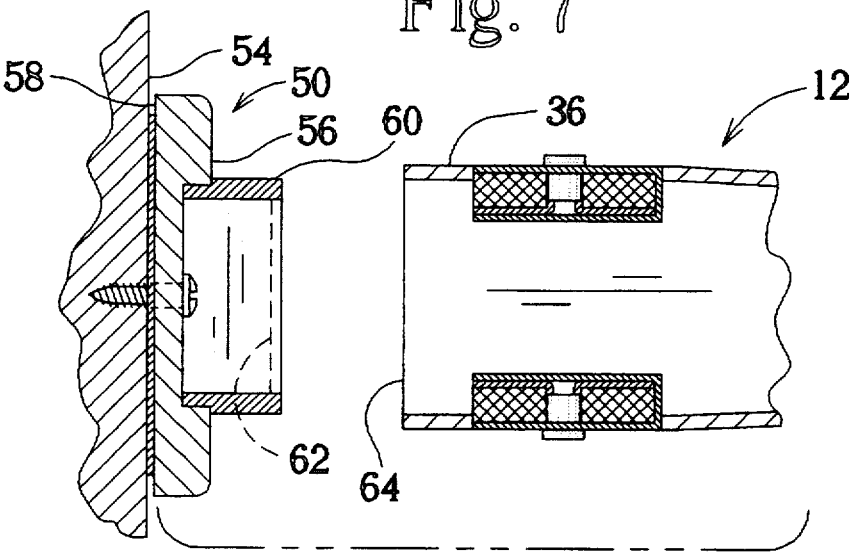
FIG. 7 is an exploded top plan view, in section, of one embodiment of the improved magnetic soap holder taken at C—C of FIG. 6.

An improved magnetic soap holder incorporating various features of the present invention is illustrated generally at 10 in the figures. The improved magnetic soap holder 10 comprises an arm 12, a base 50, a soap-holding magnet 20, a soap-holding-magnet housing 18, an arm underside covering 24, and a soap-holding plate 14. In an alternate embodiment, the improved magnetic soap holder 10 also includes one or more utensil-holding magnets 30.

In the preferred embodiment, the base 50. has a first side 56 and a second side 58. The base 50 is mounted at its second side 58 to a wall or other substantially vertical supporting surface 54. This is achieved by use of a securing means 48, which is any conventional mounting device, secured on the second side 58 of the base 50. The securing means 48 could be, but is not limited to being, an adhesive patch 44 between the wall and the second side 58 of the base 50, screws 46, or glue.

In the preferred embodiment, the improved magnetic soap holder 10 includes a connector for joining the base 50 to the arm 12. The connector 60 includes at least one securing ridge 62. The securing ridge 62 is a small ridge which runs the width of the connector 60.

In the preferred embodiment, the arm 12 is shaped as generally shown in the figures and has a first end 32 and a second end 36. The arm 12 is long enough to accommodate a large family-sized bar of soap. This allows the arm 12 to hold a bar of soap so that the soap's longer axis is substantially parallel to the longer axis of the arm 12. However, the soap may be oriented in any attitude. In this way, the arm 12 also covers much of the soap.

The second end 36 of the arm 12 includes a securing opening 64. The securing opening 64 is dimensioned so as to cooperate with the connector 60.

The arm 12 also includes, near its first end 32, a soap-holding-magnet compartment 16, as shown in FIGS. 3 and 4. The soap-holding-magnet compartment 16 is dimensioned so as to accept a soap-holding magnet 20 and its soap-holding-magnet housing 18. Inside the soap-holding-magnet compartment 16, there is a boss 22. The boss 22 is a small ridge running the width of the arm 12 which helps to keep the soap-holding-magnet 20 and its soap-holding-magnet housing 18 in place after assembly. Inside the soap-holding-magnet compartment 16, there is also a guide 68 which helps guide the soap-holding magnet 20 and its soap-holding-magnet housing 18 into place during assembly.

There is also an arm underside covering 24 in the preferred embodiment of the improved magnetic soap holder 10. This arm underside covering 24 is preferably made of the same material as the rest of the arm 12. The arm underside covering 24 includes two slots 66 dimensioned so as to snugly accept the downward bent flanges 28 of the soap-holding-magnet housing 16. (See FIG. 5). The arm underside covering 24 may be a separate piece or may be integrally formed with the rest of the arm 12.

In the preferred embodiment of the improved magnetic soap holder 10, there is a soap-holding magnet 20. The soap-holding magnet 20 is rectangular or square and has a substantially uniform thickness.

The soap-holding-magnet 20 is retained within a soap-holding-magnet housing 18. The soap-holding-magnet housing 18 is a u-shaped piece of magnetically activatable material. The soap-holding-magnet housing 18 has length and width slightly greater than the soap-holding magnet 20 and includes downward bent flanges 28. The downward bent flanges 28 are either only on one set of opposing sides or on all four sides. The soap-holding-magnet housing be is fitted over the soap-holding magnet 20.

In an alternate embodiment, there is more than one soap-holding-magnet housing 18 and associated soap-holding magnet 20.

The preferred embodiment of the improved magnetic soap holder 10 also comprises a soap-holding plate 14. The soap-holding plate 14 is made from a magnetically activatable material which resists rusting. The soap-holding plate 14 is substantially planar but may be any shape within that plane and includes a securement device such as downward bent flanges 26 which allows the soap-holding plate 14 to be secured to a bar of soap by pressing the downward bent flanges 26 into the bar. It is envisioned that other methods of securing the soap to the soap-holding plate 14 may be incorporated as well.

To assemble the improved magnetic soap holder 10, the soap-holding magnet 20 is fitted into the soap-holding-magnet housing 18. The soap-holding magnet 20 and the soap-holding-magnet housing 18 are then fitted into the soap-holding-magnet compartment 16 in the first end 32 of the arm 12 such that the downward bent flanges 28 of the soap-holding-magnet housing 18 are received through the slots 66 in the arm underside covering 24. The soap-holding magnet 20 and the associated soap-holding-magnet housing 18 are held in the soap-holding-magnet compartment 16 by the boss 22. Next, the base 50 is mounted onto the supporting surface 54. Then, the arm 12 is secured to the base 50 by fitting the securing opening 64 of the arm 12 over the connector The arm 12 is held in place by means of the securing ridge 62 on the connector 60. The arm 12 is mounted such that the angle theta 52 between the supporting surface 54 and the arm 12 is substantially ninety degrees. In an alternate embodiment, the angle theta 52 is any angle greater than ninety degrees allowing drippage of soap to be directed away from the base 50 and, for instance, into the sink.

In the preferred embodiment, the soap-holding plate 14 is then secured to a bar of soap by pressing the downward bent flanges 26 into the bar. The improved magnetic soap holder 10 is used by bringing the bar of soap with the soap-holding plate 14 into magnetic contact with the downward bent flanges 28 of the soap-holding-magnet housing 18.

In another embodiment, the connector 60 is on the second end 36 of the arm 12 and the first side 56 of the base 50 includes the securing opening 64 into which the connector is received. In yet another alternate embodiment, the connector 60 is included on the first side 56 of the base 50.

In yet another alternate embodiment, the arm 12 and the base 50 are integrally formed. (See FIG. 1).

In another alternate embodiment, the improved magnetic soap holder 10 also includes one or more utensil-holding magnets 30. Each utensil-holding-magnet 30 is substantially like the soap-holding magnet 20 described above. Each utensil-holding magnet 30 is rectangular or square and has a uniform thickness. Each utensil-holding magnet 30 also includes an associated utensil-holding-magnet housing 38. Each utensil-holding-magnet housing 38 is a u-shaped piece of magnetically activatable material. Each utensil-holding-magnet housing 38 has slightly greater length and width than its associated utensil-holding magnet 30 such that the utensil-holding-magnet housing 38 fits snugly over its utensil-holding magnet 30. The utensil-holding magnet 30 includes downward bent flanges 42. The downward bent flanges 42 are either only on opposing sides or on all four sides. Each utensil-holding-magnet housing 38 is then fitted over its utensil-holding magnet 30.

In this alternate embodiment, there are also utensil-holding-magnet compartments 34 located near the second end 36 of the arm 12. The utensil-holding-magnet compartments 34 are dimensioned so as to accept one utensil-holding magnet 30 with its associated utensil-holding-magnet housing 38.

In this alternate embodiment of the improved magnetic soap holder 10, one or more utensil-holding pieces 40 are needed. A utensil-holding piece 40 is an adhesively-backed piece made from a rust-resistant, magnetically activatable material. Each utensil-holding piece 40 is small enough to fit onto a suitable part of a utensil such as a toothbrush, safety razor, or comb. Each utensil-holding piece 40 is attached to its utensil by the adhesive backing. The utensil-holding piece 40 is magnetically attracted to the utensil-holding magnet 30 and, thus, holds a utensil suspended above surrounding surfaces.

If one or more utensil-holding magnets 30 are used, each utensil-holding magnet 30 is inserted into its utensil-holding-magnet housing 38. Each utensil-holding magnet 30 is then inserted into its utensil-holding-magnet compartment 34. A utensil-holding piece 40 is secured to the back of each utensil to be used. The utensil with the utensil-holding piece 40 secured to it is brought near the second end 36 of the arm 12 such that the utensil-holding piece 40 is nearest to the utensil-holding magnet 30. The magnetic force exerted by the utensil-holding magnet 30 upon the utensil-holding piece 40 suspends the utensil above any surrounding surfaces allowing the utensils to be securely held and air dried.

From the foregoing description, it will be recognized by those skilled in the art that an improved magnetic soap holder 10 offering advantages over the prior art has been provided. Specifically, the improved magnetic soap holder 10 provides a means for holding a bar of soap such that the bar of soap is substantially covered by the arm 12 so that the bar of soap is not easily knocked off. The improved magnetic soap holder 10 is also easier to clean than previous magnetic soap holders because the soap-holding magnet 20 is covered by the arm underside covering 24. The improved magnetic soap holder 10 also includes a boss 22 inside of each soap-holding-magnet compartment 16 so that the combination of the soap-holding magnet 20 and the soap-holding-magnet housing 18 are easily snapped into the soap-holding-magnet compartment 16. In an alternate embodiment, the improved magnetic soap holder 10 also includes one or more utensil-holding magnets 30 which hold up such items as toothbrushes or safety razors.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. An improved magnetic soap holder for suspending a bar of soap, said improved magnetic soap holder comprising:

an arm defining a first end and a second end, said arm being dimensioned to secure said bar of soap such that a longitudinal axis defined by said bar of soap is substantially parallel to a longitudinal axis defined by said arm, said arm including at least one soap-holding-magnet compartment near said first end, said arm including a securing opening in said second end;

a base defining a first side and a second side;

a connector, said connector being for joining said first side of said base to said arm, said connector being dimensioned so as to cooperate with said securing opening of said arm;

at least one soap-holding magnet, each said soap-holding magnet being rectangular and having a uniform thickness, each said soap-holding magnet being dimensioned so as to be accepted into one said soap-holding-magnet compartment, each said soap-holding magnet including a soap-holding-magnet housing, each said soap-holding-magnet housing being substantially u-shaped and being dimensioned to receive one said soap-holding magnet, each said soap-holding-magnet housing having downward bent flanges on at least one set of opposing sides, each said soap-holding-magnet housing being made of a magnetically activatable material;

at least one soap-holding plate, each said soap-holding plate being fabricated from a magnetically activatable material so as to be attracted and held by a magnetic force of said soap-holding magnet;

an arm underside covering, said arm underside covering being dimensioned so as to substantially cover the underside of said arm, said arm underside covering including slots dimensioned so as to cooperate with said downward bent flanges of said soap-holding-magnet housing;

a securement device carried by said soap holding plate for securing said bar of soap thereto; and a securing means carried on said second side of said base for securing said improved magnetic soap holder to a supporting surface.

2. The improved magnetic soap holder of claim 1 wherein each said soap-holding-magnet compartment is provided with at least one boss for retaining said soap-holding magnet.

3. The improved magnetic soap holder of claim 1 wherein said arm further includes at least one utensil-holding-magnet compartment near said second end of said arm.

4. The improved magnetic soap holder of claim 3 further comprising at least one utensil-holding-magnet, each said utensil-holding magnets being dimensioned to be received within one said utensil-holding-magnet compartment, each said utensil-holding magnet defining a rectangular configuration and having a uniform thickness.

5. The improved magnetic soap holder of claim 4 wherein each said utensil-holding magnet is received within a utensil-holding-magnet housing, each said utensil-holding-magnet housing being made of a magnetically activatable material, each said utensil-holding-magnet housing having downward bent flanges on at least one set of opposing sides.

6. The improved magnetic soap holder of claim 5 further comprising at least one utensil-holding piece, each said utensil-holding piece comprising an adhesively backed material, said material being magnetically activatable, each said utensil-holding piece for being attached to a utensil so that a magnetic force of said associated utensil-holding magnet suspends the utensil from said arm.

7. The improved magnetic soap holder of claim 1 wherein said base and said arm are integrally formed.

8. The improved magnetic soap holder of claim 1 wherein said arm includes guides for guiding each said soap-holding-magnet into said associated soap-holding-magnet compartment.

9. An improved magnetic soap holder, said improved magnetic soap holder comprising:

an arm defining a first end and a second end, said arm being dimensioned to secure said bar of soap such that a longitudinal axis defined by said bar of soap is substantially parallel to a longitudinal axis defined by said arm, said arm including at least one soap-holding-magnet compartment near said first end, said arm including a securing opening in said second end, said arm including at least one utensil-holding-magnet compartment near said second end of said arm, said arm including a securing opening in said second end;

a base defining a first side and a second side;

a securing means carried on said second side of said base for securing said base to a supporting surface;

a connector, said connector being for joining said first side of said base to said arm, said connector being dimensioned so as to cooperate with said securing opening of said arm;

at least one soap-holding magnet, each said soap-holding magnet being rectangular in the mathematical sense and having a uniform thickness, each said soap-holding magnet being dimensioned so as to be accepted into said associated soap-holding-magnet compartment;

at least one soap-holding-magnet housing, each said soap-holding-magnet housing being substantially u-shaped and being dimensioned to receive one said soap-holding magnet, said soap-holding-magnet housing having downward bent flanges on at least one set of opposing sides, each said soap-holding-magnet housing being made of a magnetically activatable material;

at least one utensil-holding magnet being dimensioned to be received within one said utensil-holding-magnet compartment, each said utensil-holding magnet defining a rectangular configuration and having a uniform thickness;

at least one utensil-holding-magnet housing, each said utensil-holding-magnet housing being made of a magnetically activatable material, each said utensil-holding-magnet housing being dimensioned to receive one said utensil-holding magnet, each said utensil-holding-magnet housing having downward bent flanges on at least one set of opposing sides;

an arm underside covering, said arm underside covering being dimensioned so as to substantially cover the underside of said arm, said arm underside covering including slots, said slots being dimensioned so as to cooperate with said downward bent flanges of said soap-holding-magnet housing;

at least one soap-holding plate, each said soap-holding plate being fabricated from a magnetically activatable material so as to be attracted and held by a magnetic force of said soap-holding magnet;

a securement device carried by said soap-holding plate for securing said bar of soap thereto; and at least one utensil-holding piece, each utensil-holding piece comprising an adhesively backed material, said material being magnetically activatable, each said utensil-holding piece for being attached to a utensil so that a magnetic force of said at least one utensil-holding magnet suspends the utensil from said arm.

10. The improved magnetic soap holder of claim 9, wherein each said soap-holding-magnet compartment is provided with at least one boss for retaining said soap-holding magnet.

11. The improved magnetic soap holder of claim 9 wherein said base and said arm are integrally formed.

12. The improved magnetic soap holder of claim 9 wherein said arm includes guides for guiding each said soap-holding-magnet and said associated soap-holding-magnet housing into said soap-holding-magnet compartment.

13. An improved magnetic soap holder, said improved magnetic soap holder for being used to suspend a bar of soap and at least one utensil from said improved magnetic soap holder, said improved magnetic soap holder for being used in conjunction with a soap-holding plate, the soap-holding plate being fabricated from a magnetically activatable material, the soap-holding plate having downward bent flanges for removably securing the soap-holding plate to the bar of soap, said improved magnetic soap holder comprising:

an arm defining a first end and a second end, said arm being dimensioned to secure said bar of soap such that a longitudinal axis defined by said bar of soap is substantially parallel to a longitudinal axis defined by said arm, said arm including at least one soap-holding-magnet compartment near said first end, said arm including a securing opening in said second end, said arm including at least one utensil-holding-magnet compartment near said second end of said arm, said arm including a securing opening in said second end;

at least one utensil-holding magnet, each said utensil-holding-magnet being dimensioned to be received within one said utensil-holding-magnet compartment, each said utensil-holding magnet defining a rectangular configuration and having a uniform thickness;

at least one utensil-holding-magnet housing, each said utensil-holding-magnet housing being made of a magnetically activatable material, each said utensil-holding-magnet housing being dimensioned to receive one said utensil-holding magnet, each said utensil-holding-magnet housing having downward bent flanges on at least one set of opposing sides;

a base defining a first side and a second side;

a securing means carried on said second side of said base including a securing means for securing said base to a supporting surface;

a connector, said connector being for joining said first side of said base to said arm, said connector serving to hold said utensil-holding-magnets and said utensil-holding-magnet housings in position, said connector being dimensioned so as to cooperate with said securing opening of said arm;

at least one securing ridge, each said securing ridge being attached to said connector, each said securing ridge for retaining said securing opening of said arm;

at least one soap-holding magnet, each said soap-holding magnet being rectangular in the mathematical sense and having a uniform thickness, each said soap-holding magnet being dimensioned so as to be accepted into said associated soap-holding-magnet compartment;

at least one soap-holding magnet housing, each said soap-holding-magnet housing being substantially u-shaped and being dimensioned to receive said at least one soap-holding magnet, each said soap-holding-magnet housing having downward bent flanges on at least one set of opposing sides, each said soap-holding-magnet housing being made of a magnetically activatable material;

an arm underside covering, said arm underside covering being dimensioned so as to substantially cover the underside of said arm, said arm underside covering including slots, said slots being dimensioned such that said slots closely accept said downward bent flanges of said soap-holding-magnet housing; and at least one utensil-holding piece, each said utensil-holding piece comprising an adhesively backed material, said material being magnetically activatable, each said utensil-holding piece for being attached to a utensil so that a magnetic force of said at least one utensil-holding magnet suspends the utensil from said arm.

14. The improved magnetic soap holder of claim 13 wherein each of said soap-holding-magnet compartments is provided with at least one boss for retaining said soap-holding magnet.

15. The improved magnetic soap holder of claim 13 wherein said base and said arm are integrally formed.

16. The improved magnetic soap holder of claim 13 wherein said arm includes guides for guiding said soap-holding magnet and said associated soap-holding-magnet housing into said soap-holding magnet compartment.

17. The improved magnetic soap holder of claim 16 wherein said connector is integrally formed with said first side of said base.

18. The improved magnetic soap holder of claim 16 wherein said connector is integrally formed with said arm.

* * * * *